US005664517A

United States Patent [19]

Brydel et al.

[11] Patent Number: 5,664,517

[45] Date of Patent: Sep. 9, 1997

[54] PONTOON SYSTEM AND PONTOON CONNECTING SYSTEM AND PROCESS THEREFOR

[75] Inventors: Paul S. Brydel, Hilton Head Island, S.C.; William Johanek, St. Simons Island; Dennis V. Emery, Brunswick, both of Ga.

[73] Assignee: Jered Brown Brothers Inc., Brunswick, Ga.

[21] Appl. No.: 602,347

[22] Filed: Feb. 16, 1996

[51] Int. Cl.[6] ..... B63B 35/44

[52] U.S. Cl. ..... 114/266

[58] Field of Search ..... 114/230, 263, 114/266, 267, 249; 405/219

[56] References Cited

U.S. PATENT DOCUMENTS

| | | | |
|---|---|---|---|
| 3,585,959 | 6/1971 | Cook | 114/230 |
| 3,735,722 | 5/1973 | Hooper et al. | 114/249 |
| 3,983,830 | 10/1976 | Morgan | 114/266 |
| 4,080,921 | 3/1978 | Freitag | 114/249 |
| 4,256,049 | 3/1981 | Brunet et al. | 114/249 |

FOREIGN PATENT DOCUMENTS

| | | | |
|---|---|---|---|
| 1496811 | 1/1978 | United Kingdom | 114/266 |

*Primary Examiner*—Edwin L. Swinehart

*Attorney, Agent, or Firm*—Oblon, Spivak, McClelland, Maier & Neustadt, P.C.

[57] ABSTRACT

A pontoon connector system and process are provided which allows pontoons to be connected at sea, even under rough sea conditions, so that the pontoons can be connected, for example, to form a barge. Initially, the pontoons are coupled by cables which are connected to winches disposed on one of the pontoons. The cables are then wound upon the winches to draw the pontoons together until latch members can be connected between the pontoons. Once the latch members connect the pontoons together, conventional connectors can then be inserted between connector sites of the pontoons.

27 Claims, 5 Drawing Sheets

4
2
2
6
2
12
12
8
10
10
4
2

PONTOON SYSTEM AND PONTOON CONNECTING SYSTEM AND PROCESS THEREFOR

BACKGROUND OF THE INVENTION

1. Field of the Invention

The invention relates to pontoons, and particularly to a system and the process for connecting pontoons at sea.

2. Discussion of Background

Pontoons have been utilized for various military and commercial purposes. In one application, a plurality of pontoons are connected together to form a barge, which can transport cargo from ship to shore or from a ship to a pier. A barge can include, for example, an array of three by three or three by five pontoons. While two pontoons can be connected aboard a ship transporting the pontoons, due to space limitations, additional pontoons must be connected in the water.

Conventionally, each pontoon will include a plurality of connector sites, and the connector sites of adjacent pontoons are aligned with one another manually. Connectors are then inserted between connector sites of one pontoon and an adjacent connector sites of the other pontoon, thereby coupling the two adjacent pontoons together. While such a manual alignment and connecting procedure is sufficient under calm sea conditions (e.g., up to one foot waves), it is not possible to manually align and connect pontoons under rougher sea conditions, such as sea state 3 conditions (five to six foot waves). Under rough sea conditions, it is impossible to manually control the pontoons to align connector sites, and damage to the pontoons or injury to the crew can result when the pontoons collide.

Accordingly, a system and process is needed which allows pontoons to be aligned and connected under rough sea conditions.

SUMMARY OF THE INVENTION

It is an object of the invention to provide a system and process for connecting pontoons.

It is a further object of the invention to provide a system and process for connecting pontoons which can be utilized in both rough and calm sea conditions.

The above and other objects and advantages are achieved in accordance with the present invention in which adjacent pontoons are controllably brought together and aligned, and thereafter the pontoons are coupled with a latch assembly. Once latched, the pontoons are aligned and stable with respect to one another so that the conventional connectors can be inserted.

Initially, the pontoons are coupled utilizing cables, which are controlled by winches disposed on one of the pontoons. The cables are wound upon their respective winches until the pontoons are sufficiently close so that the latch connectors can be connected between the two pontoons. The latch connectors ensure that the pontoons are properly spaced with respect to one another and stable with respect to one another so that the conventional connectors can then be installed to complete the connection. In a particularly preferred embodiment, the latch connectors couple shoot bolts of adjacent connector sites, and various components of the cable system are mounted in other connector sites, thus maximizing use of the existing pontoon structures and minimizing structural modifications.

BRIEF DESCRIPTION OF THE DRAWINGS

A more complete appreciation of the invention and many of the attendant advantages thereof will become readily apparent from the following detailed description, particularly when considered in conjunction with the drawings in which.

DESCRIPTION OF THE PREFERRED EMBODIMENTS

Figure 1:
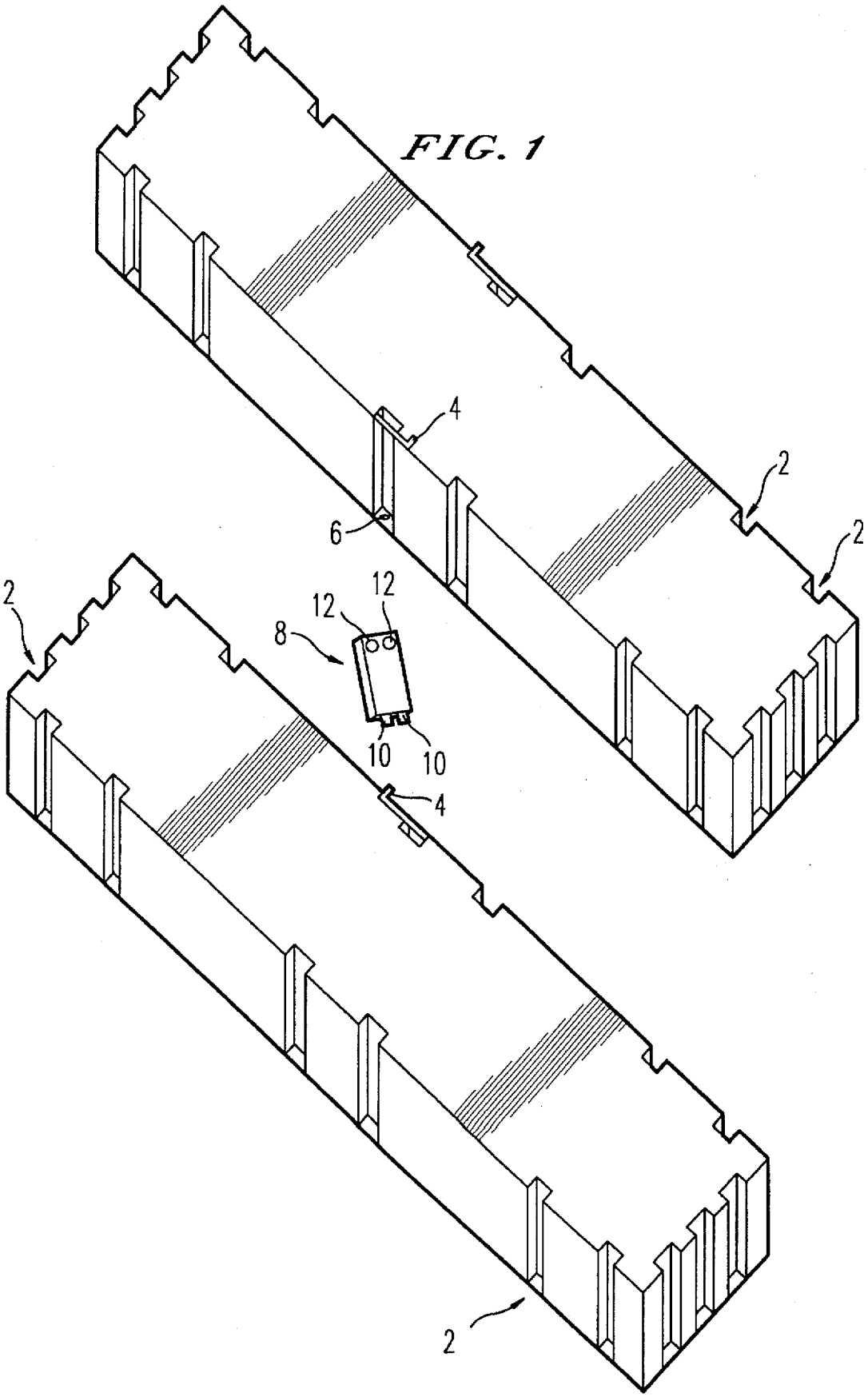
FIG. 1 is a perspective view of a pair of pontoons and a connector therefor.

Referring now to the drawings, wherein like reference numerals designate identical or corresponding parts throughout the several views, FIG. 1 depicts a pair of conventional pontoons as well as a connector therefor. Each pontoon includes plural connector sites 2 disposed along each side of the pontoon. By way of example, as shown in FIG. 1, six connector sites 2 are disposed along the longer sides of each pontoon, while three connector sites are provided along the shorter sides. At the top of each connector site, a shoot bolt 4 is provided. For ease of illustration, only two shoot bolts 4 are shown in FIG. 1. The shoot bolts 4 are movable so that they can be selectively positioned, between open and closed positions. In the closed position, the shoot bolts extend across their respective connector site (e.g., to hold a connector in place), while in the open position, the shoot bolt 4 is retracted so that it does not extend across the connector site (to allow insertion or removal of a connector). At the bottom of each connector site 2, a socket 6 is provided for receiving posts or pins of conventional connectors.

FIG. 1 also schematically depicts a conventional connector 8, which is utilized for joining adjacent pontoons. The connector includes a pair of pins 10 at the bottom thereof, while a pair of apertures 12 are provided at the top. Although not shown in FIG. 1, conventionally one of the pins 10 is movable to provide a limited amount of play when the pins 10 are inserted into the sockets 6.

When connecting adjacent pontoons, the pontoons are aligned such that the connector sites of one pontoon are aligned with the connector sites of another pontoon. A connector 8 is then inserted between the pontoons such that one of the pins 10 is received in a socket 6 of one of the pontoons, while the other pin 10 is received in a socket 6 of another pontoon. The shoot bolts are then moved to extend across each connector site and through the apertures 12 of the connector. Once the connectors are inserted into some or all of the connector sites between adjacent pontoons, the pontoons are securely connected together. Additional pontoons are then connected to provide the desired barge size and configuration.

Prior to the present invention, the alignment and connection of pontoons was accomplished manually, and as a result, the connection of pontoons was only possible in calm sea conditions of, for example, one foot waves. Under rougher sea conditions, it was virtually impossible to maintain adjacent pontoons stable while aligning the connector sites so that the connectors 8 can be inserted. Moreover, attempted alignment of the pontoons in rough sea conditions can result in damage to the pontoons, for example, where a corner edge of one pontoon impacts the side of another pontoon.

Figure 2:
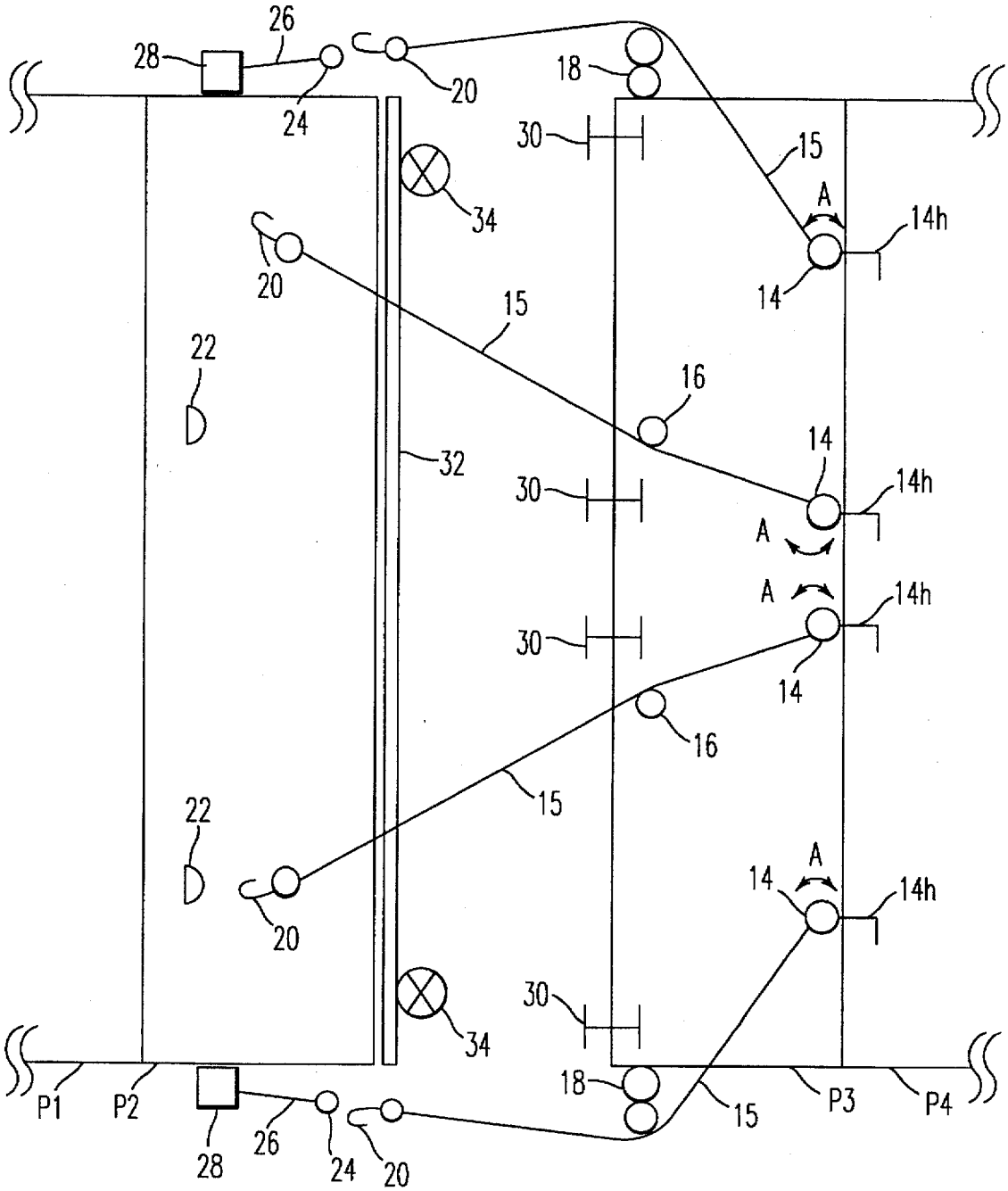
FIG. 2 is a plan view schematically depicting the components of the connector system and process of the present invention.

Referring now to FIG. 2, a connecting system and process in accordance with the present invention will now be described. In FIG. 2, a pair of pontoons, P1, P2 are to be connected to a second pair P3, P4 (the connector sites are omitted in FIG. 2 for ease of illustration). The pontoons are illustrated in pairs, since it is possible to connect a pair of pontoons on board a ship. However, additional connections must be made at sea due to space limitations. The system of FIG. 2 includes a plurality of winches 14, four of which are provided in the embodiment of FIG. 2. Preferably, the winches are pivotally mounted upon the pontoon P3 (as indicated by arrows A) for flexibility in positioning the winches so that: (1) the winches can be aligned in the direction at which a cable extends or is being wound, and (2) the winches of one pontoon, e.g., P3 can be utilized for positioning and connecting pontoons at various locations about the pontoon P3. For example, after the winches 4 are utilized for coupling the pontoons P1, P2 to the pontoons P3, P4, one or more additional pontoons can be connected to the right of pontoon P4, or additional pontoons can be connected to the ends of the pontoons P1–P4. Of course, variations in the number of winches are possible, and if desired, the winches can be movably mounted or repositionable to assist in connecting successive pontoons together. Further, while the winches are all disposed on one pontoon in FIG. 2, it is also possible to provide some of the winches on one pontoon, with others disposed on another pontoon if desired. In addition, while the winches 14 shown in FIG. 2 are manually operated utilizing hand cranks 14*h*, motorized winches can also be utilized.

The winches each include a respective cable 15 which, in combination, provide for a controlled movement of the pontoons toward one another. As shown in FIG. 2, preferably the cables 15 from the central winches 14 extend about pulleys 16, so that they extend away from one another, and at an oblique angle with respect to the side of pontoon P2. This arrangement allows for lateral positioning and control of the pontoons while they are being moved toward one another. By contrast, the cables 15 of the outer winches 14 (i.e., the winches at the top and bottom of FIG. 2) provide cables which extend over a double pulley assembly 18, which will be described in further detail hereinafter.

The double pulley assembly 18 allows the outer cables 15 to extend from a location atop the pontoon P3 to a location beneath the surface of the pontoon P3, so that the outer cables provide a subsurface connection between the pontoons P2 and P3. This outer winch and double pulley arrangement provides control and stability with respect to rocking movements of the pontoons during alignment and connection.

Hooks 20 are disposed at the end of each of the cables 15 for coupling the respective cables to the pontoon P2. The inner or central cables 15 can be connected to the pontoon P2, for example, utilizing a conventional D-ring 22 fixed to the top surface of the pontoon P2. In the embodiment shown in FIG. 2, the outer cables are connected to a ring or fairlead 24 which, in turn, are connected to mounting/support posts 28 via cables 26. The rings or fairleads 24 are connected to the support posts 28 by cables 26 to allow the fairleads 24 to be raised above the water level or to the top of a pontoon, thereby easing connection of the hook 20 to the fairlead 24. After connecting the hook 20 to the fairlead 24, the hook and fairlead are dropped into the water so that the outer winch and pulley assemblies draw the pontoons together at a location below the pontoon surfaces. Of course, alternate coupling arrangements are possible in lieu of the hook and ring couplings. In addition, alternate connections for the support post 28 are also possible (for example by providing a connector which can be selectively moved up and down along the support post).

As also shown in FIG. 2, upper latch assemblies 30 are provided. These latch assemblies at least temporarily couple the pontoons after they have been drawn together by the winch assemblies. The latch assemblies 30 connect adjacent shoot bolts of adjacent connector sites, and are sized so that when they couple adjacent shoot bolts, they fix the spacing between the pontoons P2, P3 so that the connectors 8 can then be inserted into connector sites not occupied by the latches 30.

Although the present invention provides superior control in drawing pontoons together, sea conditions can nevertheless cause the pontoons to collide causing damage. Accordingly, a matting 32 is preferably provided along the pontoon sides to absorb impact without causing damage. In addition, removable fenders, represented at 34, are also provided to absorb larger forces which can occur as the pontoons are being drawn together under rough conditions. Once the pontoons are sufficiently close to require removal of the fenders 34, the pontoons are sufficiently close and sufficiently coupled/stable so that large impact forces of the pontoons with respect to another will not typically occur. The fenders 34 can be mounted, for example, upon ropes so that a crew member can easily withdraw the fenders 34 from between the pontoons.

In operation, the latch assemblies 30 are mounted upon shoot bolts by inserting the shoot bolt through an aperture of each latch assembly 30. The cables 15 of the respective winch assemblies are then connected to the D-rings 22 and fairleads 24, and the fenders 34 are positioned between the pontoons P2, P3. The winch handles 14*h* are then cranked, preferably simultaneously, to draw the pontoons P2, P3 together. As mentioned earlier, by virtue of the angular positioning of the inner winch cables 15, as well as the extension of the inner cables 15 away from one another, as the pontoons P2, P3 are drawn together they are aligned with one another laterally (i.e., in the vertical direction of FIG. 2). In addition, by virtue of the subsurface coupling of the pontoons P2, P3 via the double pulley assembly 18, relative rocking motion between the pontoons is sufficiently stabilized as the pontoons are drawn together. Once the pontoons are sufficiently close together, the fenders 34 are removed, and the winches draw the pontoons further together until the latches 30 of the pontoon P3 can be flipped onto respective shoot bolts of the pontoon P2.

Once the latches 30 are coupled between the pontoons P2, P3, the spacing between the pontoons is fixed, so that the connecters 8 can be installed, to achieve the final connection between the pontoons. By way of example, as shown in FIG. 2, four upper latch assemblies 30 are provided, so that two of the connector sites 2 (FIG. 1) are vacant. After the upper latch assemblies 30 connect the respective pontoon shoot bolts together, the connectors 8 are then inserted into the connector sites 2 which are not occupied by a latch assembly 30. Then, the latch assemblies 30 can each be removed and replaced with a connector 8. A connector 8 can thus be installed into each of the connector sites 2, and the connection of the pontoons P2, P3 is complete.

Figure 3:
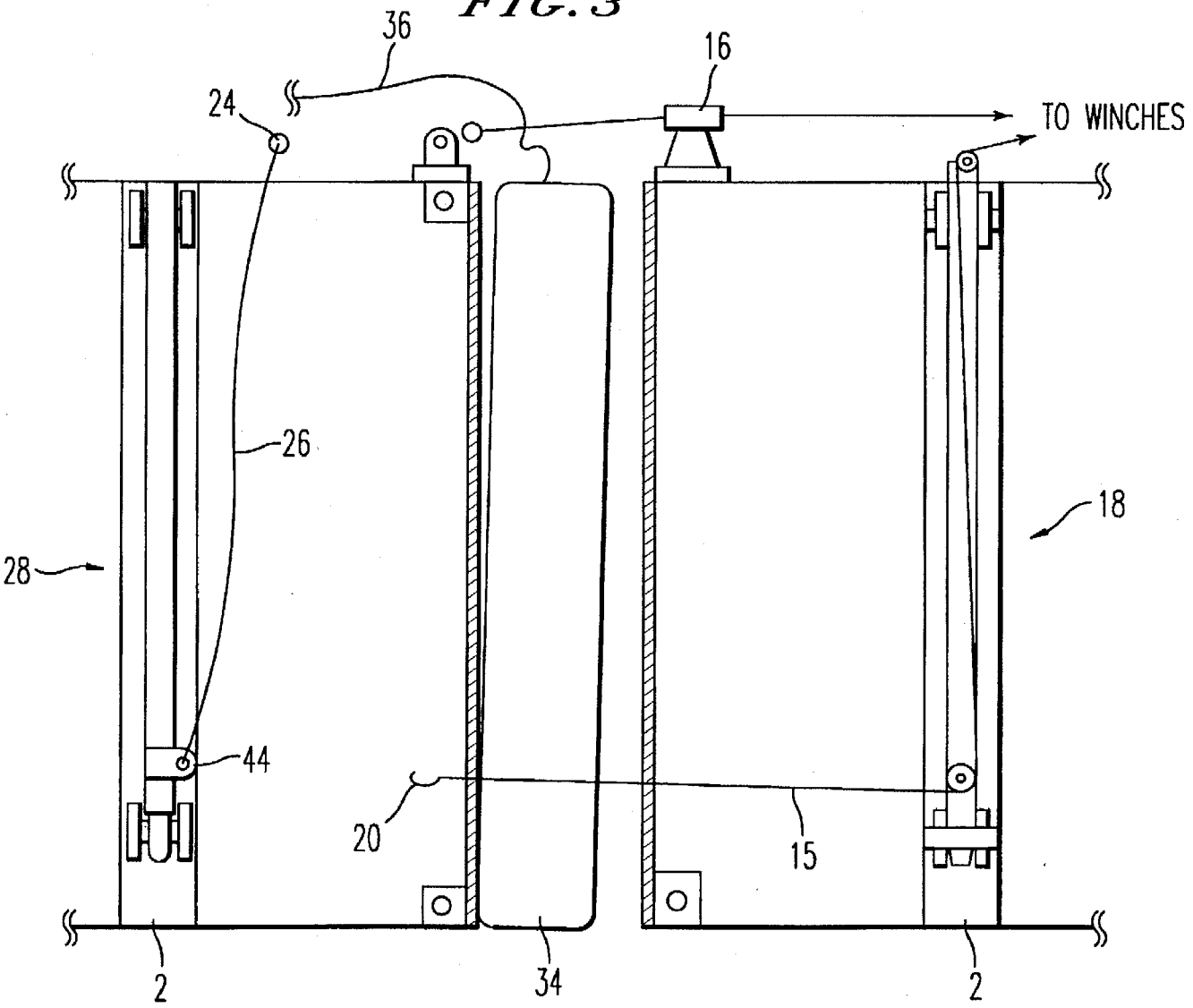
FIG. 3 is a side view of the connector system of the present invention.

Referring now to FIG. 3, a side view is provided to illustrate the coupling provided by the double pulley assembly 18 and a support post 28. As should be readily apparent from FIG. 3, the cable 15 extends from a location atop the pontoon to a level below the top of the pontoon, and preferably to a level such that the cable 15 will be under water in use, for example, at least below the half-way point of the side of the pontoons. In a preferred form of the invention, the double pulley assembly 18 and the support post 28 can be mounted at connector sites 2 as will be discussed further hereinafter. As a result, the connector sites 2 provide for stable, removable mounting of the double pulley assembly 18 and support post 28, while avoiding the need for structural modifications to the pontoons for mounting the double pulley assembly and support post.

As mentioned earlier, the support post 28 will preferably include a fairlead 24 and cable 26 so that the hook 20 can be connected to the fairlead 24 above the pontoon, and then dropped into the water. Once the winch retracts the cable 15, the force drawing the pontoons together via the double pulley assembly 18 is thus at a level below the top of the pontoon, while the pulleys 16 draw the pontoons together from a location above the top of the pontoons.

FIG. 3 also depicts the fender or bumper member 34 which can be, for example, a cylindrical shaped article formed of a shock/impact absorbent material. When the pontoons are sufficiently close such that removal of the fenders 34 is required, the fenders 34 can be removed from between the pontoons utilizing a rope or cord 36.

Figure 4A:
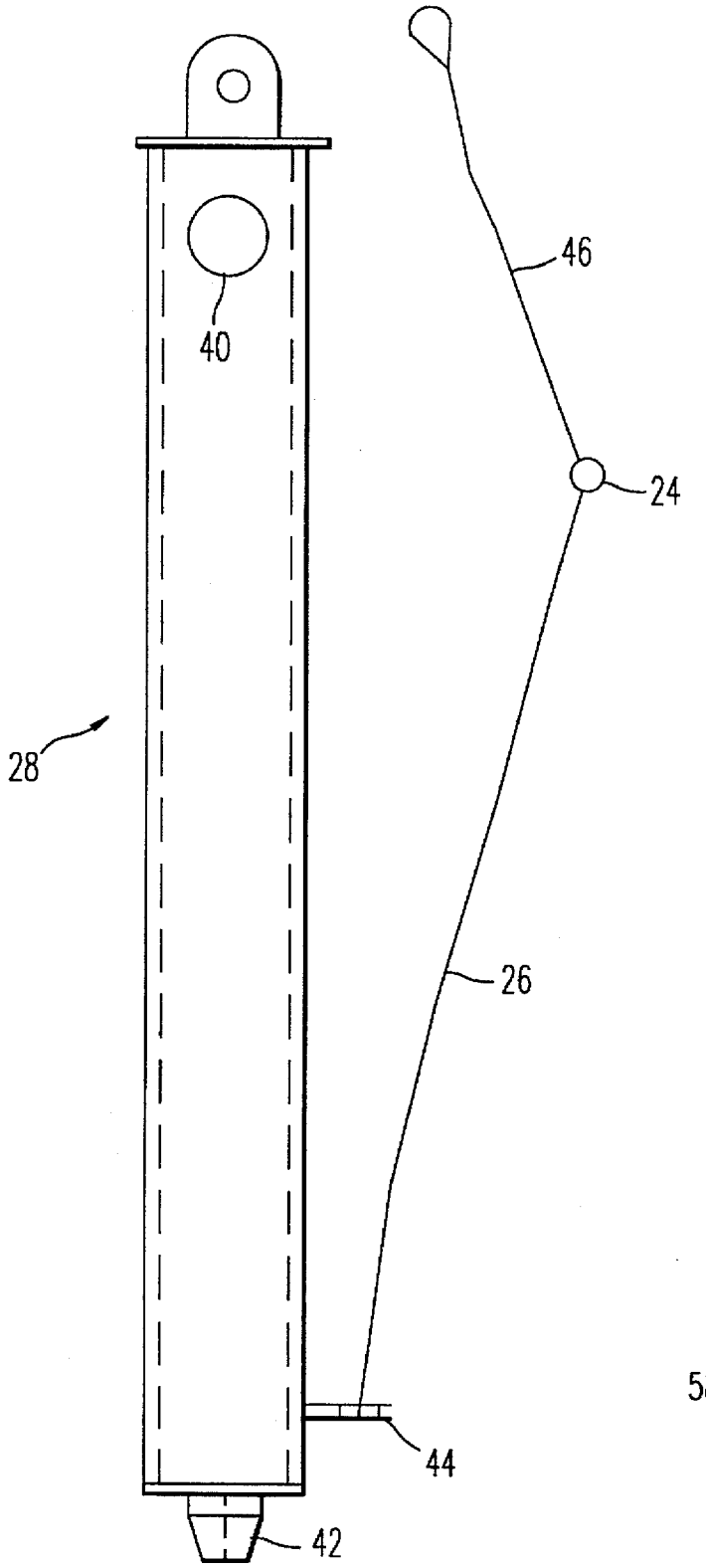
FIGS. 4A and 4B, respectively, depict the support post and double pulley arrangement for the side pulley/lower cable system assembly of the present invention.
Figure 4B:
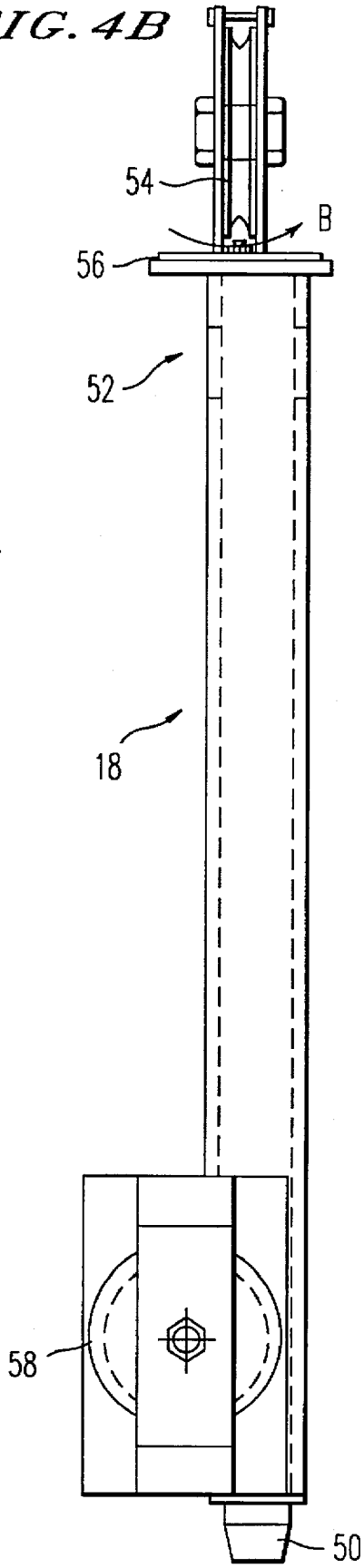

Turning now to FIGS. 4A and 4B, the support posts 28 and double pulley assembly 18 will be described in further detail. In FIG. 4A, the support post 28 is rotated 90° as compared with the actual positioning of the support post 28 with respect to the position of the double pulley assembly in FIG. 4B, to depict the aperture 40 of the support post 28 which receives a shoot bolt. The lower end of the post 28 includes a pin member 42 which is received in the socket 6 (FIG. 1) of a connector site, and a ring member or padeye 44 is provided for connection of the fairlead and cable 24, 26. An additional cable/rope handle 46 can also be provided to ease retrieval of the fairlead 24 from beneath the surface of the water. In particular, the handle member 46 can be maintained above the top of a pontoon even when the fairlead 24 is disposed below the water level. Thus, after the fairlead 24 is connected to a hook 20, the fairlead 24 can be tossed back into the water, such that the cable 15 draws the pontoons together at a level below the top of the pontoons, while the handle member is maintained at a location above the top of a pontoon to allow for subsequent raising of the fairlead 24 when it is desired to disconnect the fairlead 24 from a hook 20.

As shown in FIG. 4B, the double pulley assembly 18 also includes a lower pin 50 so that the double pulley assembly can also be removably positioned in a socket 6 of a connector site 2. The double pulley assembly 18 also includes an aperture 52 through which a shoot bolt 4 extends when the double pulley assembly is mounted in a connector site 2. As indicated by arrow B, the upper pulley 54 of the double pulley assembly is preferably pivotally mounted at 56, so that the pulley 54 can be aligned with its winch 14, thereby ensuring smooth and efficient cooperation of the winch and cable over the double pulley assembly 18. The lower pulley 58 is fixed, ensuring that the cable is properly aligned and positioned with respect to the support post 28. Thus, cable 15 passes over the top, pivotally mounted pulley 54, then extends down along the side of a pontoon, and after passing over the pulley 58, extends toward the support post 28 mounted upon the adjacent pontoon.

Figure 5A:
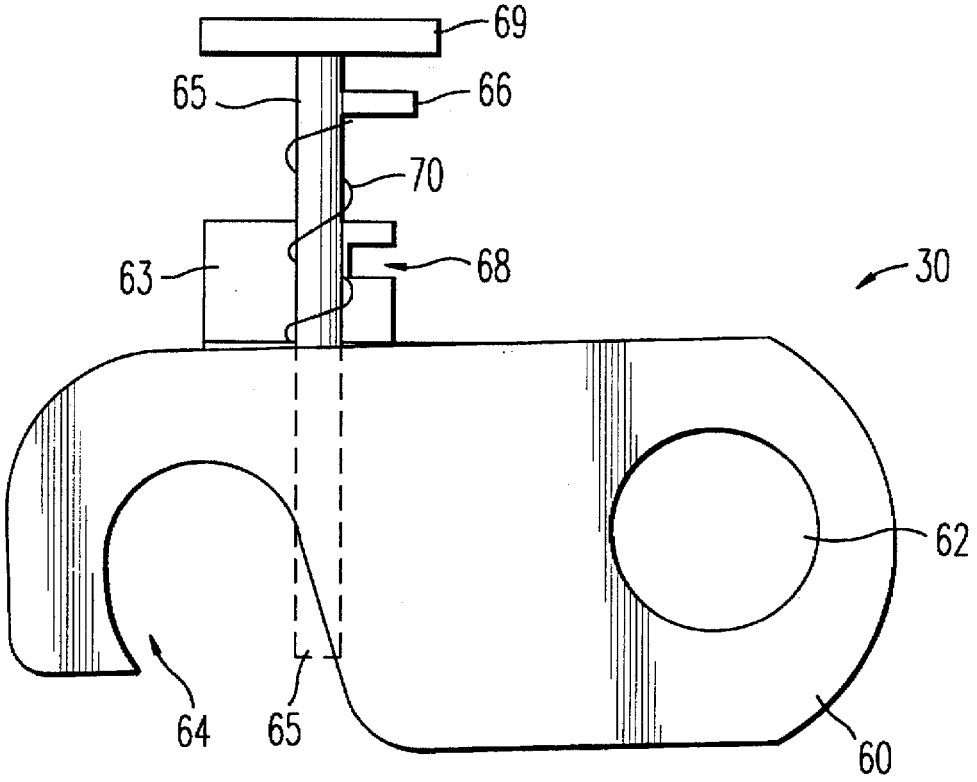
FIGS. 5A and 5B depict side and bottom views of the upper latch assembly of the present invention.
Figure 5B:
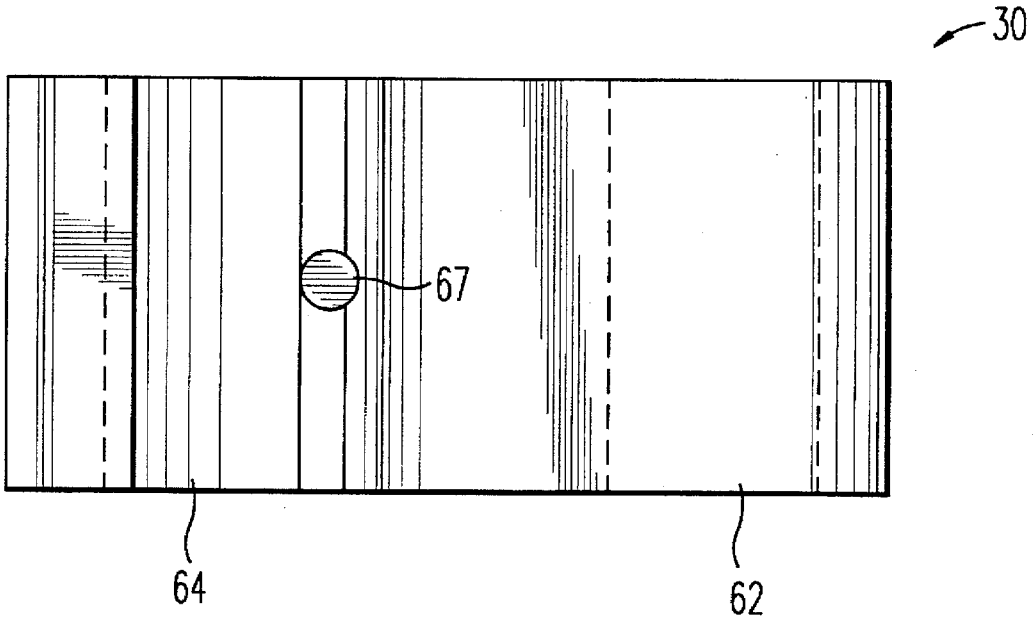

FIGS. 5A and 5B, respectively, depict side and bottom views of an upper latch assembly 30. As shown in FIG. 5A, the latch assembly 30 includes a latch member 60 having an aperture 62 which receives a shoot bolt 4 (FIG. 1). In addition, the latch member 60 includes an open aperture or slot 64 which receives the shoot bolt of the adjacent pontoon. The spacing between the apertures 62, 64 corresponds to the spacing between adjacent apertures 12 of a connector 8. Thus, once the latch member 60 is in place and connects shoot bolts of adjacent pontoons, the proper spacing between pontoons is ensured so that connectors 8 (FIG. 2) can be inserted at connector site locations not occupied by latch members 60, and thereafter, the latch members 60 can be replaced with the connectors 8.

The latch member 60 is initially positioned upon a shoot bolt of one of the pontoons via aperture 62, and once the pontoons are drawn together utilizing the winches, the latch member 60 is pivoted (about the shoot bolt 4 extending through aperture 62) so that the aperture or slot 64 hooks onto the shoot bolt of the adjacent pontoon. A pin 65 is then pushed down through an aperture 67 (FIG. 5B) of the latch member, so that the pin 65 partially blocks the aperture 64 as shown in broken line in FIG. 5A. When the pin 65 is in the down position, the aperture 64 is sufficiently blocked so that the shoot bolt cannot be removed from the aperture 64. As further shown in FIG. 5A, the pin 65 can include a lock pin 66. Once the pin 65 is moved to the down position, the pin 65 can be rotated via handle 69 so that the pin 66 is received in a slot 68 of a mounting bracket 63, thus locking the pin 65 in the down or locked/closed position. A spring 70 can be disposed along the shaft of the pin 65 to assist in unlocking or removing the pin 65 once the lock pin 66 is rotated out of slot 68.

As should be apparent from the foregoing, the present invention provides a reliable system and process for connecting pontoons despite rough sea conditions, and can be utilized to connect pontoons under conditions at least up to sea state 3 (5 to 6 foot waves). As should also be apparent, the present invention ensures alignment and spacing of adjacent pontoons utilizing the winch/cable assemblies and latch assemblies, so that the connectors 8 can be readily inserted between connector sites of adjacent pontoons. Moreover, additional mounting hardware of the various components of the connector system are minimized, by providing components (such as the double pulley assembly 18 and support post 28) which are compatible with existing connector sites of the pontoons.

Obviously, numerous additional modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States:

1. A pontoon system having a connector system for connecting pontoons comprising:

a first pontoon having at least one connector site;

a second pontoon having at least one connector site;

a plurality of winches, each of said plurality of winches disposed on one of said first pontoon and said second pontoon and having a cable which is connected to the other of said first pontoon and said second pontoon, and wherein said plurality of winches include at least a first winch and a second winch;

a first pulley assembly for the first winch, said first pulley assembly guiding the cable of the first winch so that the cable extends above top surfaces of each of said first and second pontoons;

a second pulley assembly for the second winch, said second pulley assembly guiding the cable of the second winch so that the cable of the second winch extends between the first and second pontoons at a location below the top surfaces of the first and second pontoons; and a connector which connects the at least one connector site of the first pontoon to the at least one connector site of the second pontoon.

2. A pontoon system as recited in claim 1, further including a third winch and a third pulley assembly for the third winch, said third pulley assembly guiding the cable of the third winch so that it extends above top surfaces of each of said first and second pontoons, and wherein said cables of said first and third winches extend between said first and second pontoons, and said cable of said first winch extends in a direction away from said cable of said second winch.

3. A pontoon system as recited in claim 1, further including a latch member for coupling the first pontoon to the second pontoon after the first and second pontoons are drawn together by said plurality of winches, and wherein said latch member couples said first pontoon and said second pontoon at a location adjacent top surfaces of each of said first pontoon and said second pontoon.

4. A pontoon system as recited in claim 3, wherein said connector includes means for connecting said first pontoon and said second pontoon at a first location adjacent top surfaces of said first pontoon and said second pontoon and at a second location adjacent bottoms of said first pontoon and said second pontoon.

5. A pontoon system having a connector system for connecting pontoons comprising:

a first pontoon having a first plurality of connector sites;

a second pontoon having a second plurality of connector sites;

each connector site of said first plurality of connector sites and said second plurality of connector sites comprises;

(i) a shoot bolt disposed adjacent a top surface of a respective one of said first and second pontoons, said shoot bolt movable between an open position which allows access to the connector site and a closed position at which the shoot bolt extends across the connector site, and (ii) a socket disposed adjacent the bottom of a respective one of said first and second pontoons;

a plurality of winches disposed on at least one of said first pontoon and said second pontoon, each of said winches including a respective cable for connecting a winch disposed on one of said first and second pontoons to the other of said first and second pontoons;

at least one latch member which couples a shoot bolt of one said first plurality of connector sites of the first pontoon to a shoot bolt of one of said second plurality of connector sites of the second pontoon at a location adjacent the top surface of said first pontoon and the top surface of said second pontoon after the first and second pontoons are drawn together by said plurality of winches; and a plurality of connectors which each connect a connector site of said first plurality of connector sites with a connector site of said second plurality of connector sites at a location adjacent the top surfaces of each said first and second pontoons, and wherein said connectors each further connect a connector site of said first plurality of connector sites with a connector site of said second plurality of connector sites at a location adjacent a bottom of each of said first and second pontoons.

6. A pontoon system as recited in claim 5, wherein said plurality of winches include a first pair of winches, each having a pulley assembly therefor for guiding respective cables of the first pair of winches so that said cables extend in a direction away from one another and at an angle with respect to one another.

7. A pontoon system as recited in claim 6, wherein the first pair of winches and their respective pulley assemblies are mounted on said first pontoon, and wherein the cables of the first pair of winches are connected to the second pontoon so that the cables extend over the second pontoon at an oblique angle with respect to said second pontoon.

8. The pontoon connecting system as recited in claim 2, wherein each of said plurality of connectors includes a pair of apertures for receiving shoot bolts, and a pair of pins for insertion into said sockets.

9. A pontoon system having a connector system for connecting pontoons comprising:

a first pontoon having a first plurality of connector sites;

a second pontoon having a second plurality of connector sites;

a plurality of winches disposed on at least one of said first pontoon and said second pontoon, each of said winches including a respective cable for connecting a winch disposed on one of said first and second pontoons to the other of said first and second pontoons;

at least one latch member which couples the first pontoon to the second pontoon after the first and second pontoons are drawn together by said plurality of winches; and a plurality of connectors which each connect a connector site of said first plurality of connector sites with a connector site of said second plurality of connector sites;

wherein:

(a) each connector site of said first plurality of connector sites and said second plurality of connector sites comprises:

(i) a shoot bolt movable between an open position which allows access to the connector site and a closed position at which the shoot bolt extends across the connector site, and (ii) a socket; and (b) said latch member couples a shoot bolt of one of said first plurality of connector sites with a shoot bolt of one of said second plurality of connector sites;

wherein said latch member includes an aperture which receives one shoot bolt and a slot which receives another shoot bolt.

10. A pontoon system as recited in claim 9, wherein said latch member further includes a movable pin for selectively obstructing at least a portion of said slot to lock a shoot bolt in said slot.

11. A pontoon system as recited in claim 10, further including a plurality of said latch members.

12. A pontoon system having a connector system for connecting pontoons comprising:

a first pontoon having a first plurality of connector sites;

a second pontoon having a second plurality of connector sites;

a plurality of winches disposed on at least one of said first pontoon and said second pontoon, each of said winches including a respective cable for connecting a winch disposed on one of said first and second pontoons to the other of said first and second pontoons;

at least one latch member which couples the first pontoon to the second pontoon after the first and second pontoons are drawn together by said plurality of winches; and a plurality of connectors which each connect a connector site of said first plurality of connector sites with a connector site of said second plurality of connector sites;

wherein said plurality of winches include at least a first winch and a second winch, the pontoon system further including:

(a) a first pulley assembly for the first winch, said first pulley assembly guiding the cable of the first winch so that the cable extends above top surfaces of each of said first and second pontoons; and (b) a second pulley assembly for the second winch, said second pulley assembly guiding the cable of the second winch so that the cable of the second winch extends between the first and second pontoons at a location below the top surfaces of the first and second pontoons.

13. A pontoon system as recited in claim 12, wherein:

(a) each connector site of said first plurality of connector sites comprises:

(i) a shoot bolt movable between an open position which allows access to the connector site and a closed position at which the shoot bolt extends across the connector site, and (ii) a socket; and (b) said second pulley assembly comprises:

(i) an upper pulley, (ii) a lower pulley, (iii) an aperture, and (iv) a pin, (v) wherein said aperture and said pin are sized, shaped and positioned to allow mounting of said second pulley assembly at a connector site with a shoot bolt extending through said aperture and said pin extending into a socket.

14. A pontoon system as recited in claim 13, wherein said upper pulley is pivotably mounted and said lower pulley is fixed.

15. A pontoon system as recited in claim 13, wherein said second pulley assembly is mounted in a connector site of one of said first and second pontoons, the system further including a support post mounted in a connector site of the other of said first and second pontoons, said support post comprising:

(a) means for coupling said support post to a cable;

(b) an aperture sized, shaped and positioned to receive a shoot bolt; and (c) a pin which is inserted into a socket of the connector site.

16. A pontoon system having a connector system for connecting pontoons comprising:

a first pontoon having a first plurality of connector sites;

a second pontoon having a second plurality of connector sites;

a plurality of winches disposed on at least one of said first pontoon and said second pontoon, each of said winches including a respective cable for connecting a winch disposed on one of said first and second pontoons to the other of said first and second pontoons;

at least one latch member which couples the first pontoon to the second pontoon after the first and second pontoons are drawn together by said plurality of winches; and a plurality of connectors which each connect a connector site of said first plurality of connector sites with a connector site of said second plurality of connector sites;

wherein said plurality of winches include a first pair of winches, each having a pulley assembly therefor for guiding respective cables of the first pair of winches so that said cables extend in a direction away from one another and at an angle with respect to one another;

wherein the pulley assemblies associated with the first pair of winches guide the cables of the first pair of winches so that the cables extend above top surfaces of said first and second pontoons, the pontoon system further comprising a second pair of winches each having a pulley assembly associated therewith, and wherein each pulley assembly for the second pair of winches comprises:

(a) an upper pulley disposed above a pontoon top surface; and (b) a lower pulley disposed below the pontoon top surface;

(c) wherein the respective cables of the second pair of winches each extend from the winches, over the upper pulley, and over the lower pulley so that the cables of the second pair of winches extend between the first and second pontoons at a level below the pontoon top surface.

17. A pontoon system as recited in claim 16, wherein each pulley assembly associated with the second pair of winches includes means for mounting the pulley assembly in a connector site.

18. A pontoon system as recited in claim 17, wherein the first pair of winches are disposed between the second pair of winches.

19. A pontoon system of claim 16, wherein the second pair of winches and the pulley assemblies associated with the second pair of winches are mounted on the first pontoon, the system further including a pair of support posts mounted on said second pontoon, the pair of support posts including means for connecting the cables of the second pair of winches thereto at a level below the pontoon top surface, each support post further comprising means for mounting the support post in a connector site.

20. A process for connecting pontoons comprising:

providing a first pontoon having a first plurality of connector sites;

providing a second pontoon having a second plurality of connector sites;

providing a plurality of winches disposed on at least one of said first pontoon and said second pontoon, each of said winches including a respective cable for connecting a winch disposed on one of said first and second pontoons to the other of said first and second pontoons;

winding the cables upon the winches to draw the first and second pontoons together;

connecting at least one latch member between a first connector site of the first plurality of connector sites of the first pontoon and a first connector site of the second plurality of connector sites of the second pontoon after the first and second pontoons are drawn together by said plurality of winches;

inserting a connector to connect a second connector site of said first plurality of connector sites to a second connector site of said second plurality of connector sites; and after inserting said connector, disconnecting said at least one latch member, and inserting another connector to connect said first connector site of said first plurality of connector sites to said first connector site of said second plurality of connector sites.

21. The pontoon connecting process as recited in claim 20, wherein each of said first plurality of connector sites and said second plurality of connector sites includes a shoot bolt movable between an open position which allows access to the connector site and a closed position at which the shoot bolt extends across the connector site, and wherein the step of connecting said at least one latch member between the first connector site of the first plurality of connector sites and the first connector site of the second plurality of connector sites comprises:

providing a latch member having an aperture and a slot;

inserting a shoot bolt of the first connector site of the first plurality of connector sites through the aperture of said latch member; and after the pontoons are drawn together by said plurality of winches, pivoting the latch member about the shoot bolt of the first connector site of the first plurality of connector sites until the slot of the latch member receives a shoot bolt of the first connector site of said second plurality of connector sites.

22. The pontoon connecting process as recited in claim 21, wherein each of said connector sites includes a socket, and wherein said another connector includes a pair of pins and a pair of apertures, and wherein the step of disconnecting said at least one latch member includes:

removing said shoot bolts of the first connector site of each of said first plurality and second plurality of connector sites from the aperture and slot of the at least one latch member to disconnect and remove said at least on latch member;

inserting one of said pair of pins of said another connector into the socket of said first connector site of said first plurality of connector sites and another of said pair of pins of said another connector into the socket of said first connector site of said second plurality of connector sites; and inserting the shoot bolt of each of the first connector sites through a respective one of said pair of apertures of said another connector.

23. The pontoon connecting process as recited in claim 20, wherein each of said first plurality of connector sites and said second plurality of connector sites includes a shoot bolt and a socket, and wherein each of said connector and said another connector includes a pair of pins and a pair of apertures, and wherein each of said connector and said another connector are connected between said first pontoon and second pontoon by inserting one of said pair of pins into a socket of said first plurality of connector sites and another of said pair of pins into a socket of said second plurality of connector sites, and by inserting a shoot bolt of one of said first plurality of connector sites into one of said pair of apertures and a shoot bolt of one of said second plurality of connector sites into another of said pair of apertures.

24. A process for connecting pontoons comprising:

providing a first pontoon having a first plurality of connector sites;

providing a second pontoon having a second plurality of connector sites;

providing a plurality of winches disposed on at least one of said first pontoon and said second pontoon, each of said winches including a respective cable for connecting a winch disposed on one of said first and second pontoons to the other of said first and second pontoons;

winding the cables upon the winches to draw the first and second pontoons together;

connecting at least one latch member between the first pontoon and the second pontoon after the first and second pontoons are drawn together by said plurality of winches; and inserting a plurality of connectors to connect connector sites of said first plurality of connector sites to connector sites of said second plurality of connector sites;

wherein the step of providing a plurality of winches includes providing a first pair of winches on said first pontoon, and connecting cables of said first pair of winches to the second pontoon so that the cables of the first pair of winches extend over a side of said second pontoon at an oblique angle with respect to said side;

the process further including providing a second pair of winches so that said first pair of winches are disposed between said second pair of winches; and providing a pulley assembly for each of said second pair of winches, said pulley assembly guiding cables of said second pair of winches from a location above a pontoon top surface to a location below the pontoon top surface so that the cables of the second pair of winches extend between the first and second pontoons at a location below the pontoon top surface.

25. The pontoon connecting process of claim 24, wherein each of said first plurality of connector sites and said second plurality of connector sites includes a shoot bolt movable between an open position which allows access to the connector site and a closed position at which the shoot bolt extends across the connector site, and wherein each of the connector sites further includes a socket; and wherein the step of providing a pulley assembly for each of the second pair of winches includes mounting the pulley assemblies in connector sites by inserting a shoot bolt through an aperture of each pulley assembly and inserting a pin of each pulley assembly into the socket.

26. The pontoon connecting process as recited in claim 25, wherein the step of connecting the first pontoon to the second pontoon with a latch member comprises:

providing a latch member having an aperture and a slot;

inserting a shoot bolt of the first pontoon through the aperture; and after the pontoons are drawn together by said plurality of winches, pivoting the latch member about the shoot bolt of the first pontoon until the slot receives a shoot bolt of the second pontoon.

27. A pontoon connecting process as recited in claim 26, further comprising, after insertion of at least one of said connectors, removing said latch member and inserting a connector to connect respective connector sites of said first and second pontoons vacated by said latch member.

* * * * *